United States Patent [19]

Kadjevich

[11] Patent Number: 5,040,317

[45] Date of Patent: Aug. 20, 1991

[54] PERSONALIZED DRINKING MUG

[76] Inventor: Robert M. Kadjevich, 326 Cloverdale La., Campbell, Calif. 95008

[21] Appl. No.: 224,309

[22] Filed: Jul. 26, 1988

[51] Int. Cl.[5] ..... G09F 3/00

[52] U.S. Cl. ..... 40/324; 215/13.1; 220/410; 220/662

[58] Field of Search ..... 40/324; 215/13.1, 12 R, 215/12.1; 220/82 R, 410

[56] References Cited

U.S. PATENT DOCUMENTS

| | | | |
|---|---|---|---|
| 777,305 | 12/1904 | Priestnall | 40/324 |
| 1,199,772 | 10/1916 | Engel | 215/12.1 |
| 2,169,426 | 8/1939 | Morton | 215/12.1 |
| 2,984,035 | 5/1961 | Nalle, Jr. | 40/324 |
| 3,766,975 | 10/1973 | Todd | 215/12.1 |
| 4,789,073 | 12/1988 | Fine | 40/324 |

FOREIGN PATENT DOCUMENTS

| | | | |
|---|---|---|---|
| 952 | 2/1900 | Austria | 40/324 |
| 2705806 | 1/1977 | Fed. Rep. of Germany | 40/324 |
| 561528 | 5/1975 | Switzerland | 215/13.1 |
| 1281534 | 7/1972 | United Kingdom | 215/13.1 |

*Primary Examiner*—Gene Mancene
*Assistant Examiner*—Michael Lynch
*Attorney, Agent, or Firm*—Robert B. Crouch

[57] ABSTRACT

An insulated drinking mug which includes a transparent section and a fluid receiving section telescopically received therein. Demountable entry means for introducing a placard between the sections and then sealing the entry such that the entire assembly is water tight.

2 Claims, 3 Drawing Sheets

PERSONALIZED DRINKING MUG

BACKGROUND OF THE INVENTION

The present invention relates to an insulated drinking mug and more particularly to a mug which can be personalized with photographs and messages for an individual user.

Drinking mugs of various types and configurations have been proposed: many with names or messages inscribed. Since mugs are in frequent contact with fluids, such inscriptions, to be permanent, have been applied during the manufacturing process and are, therefore, of only general interest or suitability. Insulated mugs have been proposed which are made up of two or more contrasting-colored plastic sections which are sonic welded, or otherwise permanently sealed, together to define a dead air space between the sections. In some instances a stip of colored paper has been inserted between the sections during assembly to provide a color variation or contrast.

A drinking mug is often a very personal item for the individual user. However, selecting a mug which is particularly suitable to a specific person has been difficult, and often impossible. The design or ornamentation of currently available mugs is applied during assembly or manufacture and cannot therefore reflect the particular tastes or interests of an individual user. Personalizing a typical drinking mug by the user has not been practical, since the inner and outer surfaces of the mug must be moisture proof and resistant to liquids. This has usually been accomplished by a thermosetting glaze applied over the design or ornamentation or by permanent seals between the various parts of the mug.

SUMMARY OF THE INVENTION

The present invention avoids the shortcomings of the prior known drinking mugs by provision of a cardboard placard which provides a mounting for photographs and which can be inscribed or decorated by the user and then enclosed behind a transparent section of a mug by a water tight seal. The mug includes a transparent section and an opaque or colored section with means for inserting the personalized placard between the sections and then sealing the space there-between. The transparent section thus provides a panoramic window through which the photographs, etc. on the placard can be viewed.

DETAILED DESCRIPTION OF THE INVENTION

Figure 1:
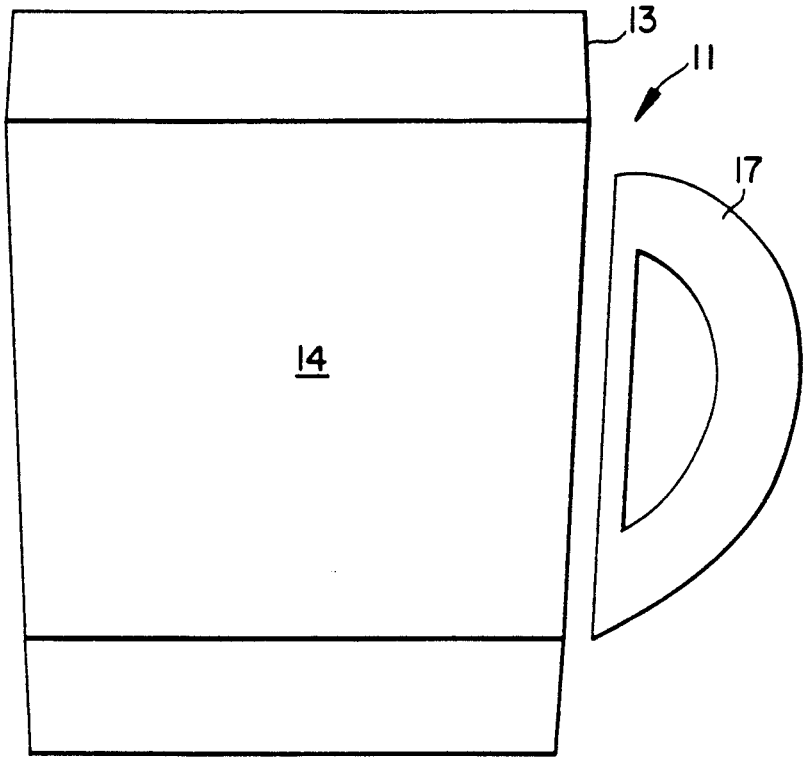
FIG. 1 is an elevation view of an insulated drinking mug according to the present invention.
Figure 10:
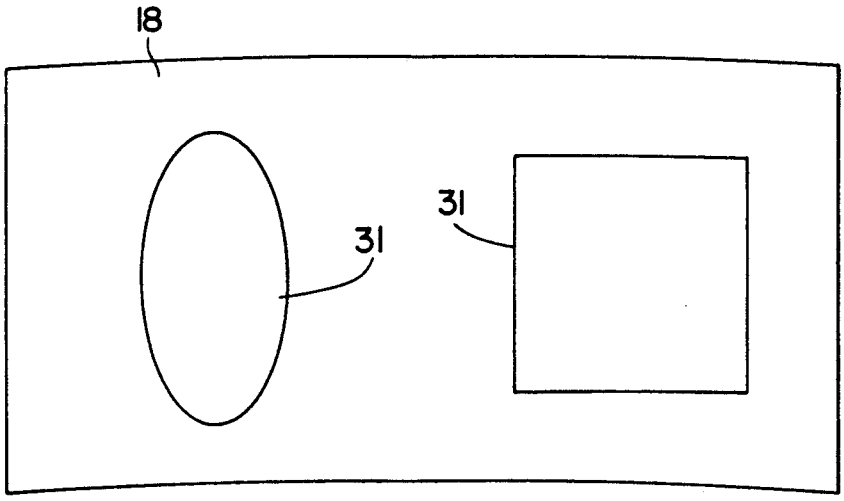
FIG. 10 is a plan view of a placard according to the present invention.

An insulated drinking mug according to the present invention is depicted in FIG. 1. The mug 11 includes a generally-cylindrical interior basket or receptacle 12 (FIG. 2) which is formed with an integral, down-turned, annular rim 13. A cylindrical exterior housing 14 surrounds the receptacle or basket 12 and is attached at its upper edge to the distel edge 15 of the rim 13 with a narrow annular space 16 therebetween. A handle 17 is adapted to be affixed to the exterior surface of the housing. A rectangular placard 18 (FIG. 10) is positioned in the space 16 and extends over the full length and height of the annulus 16 with the ends of the placard overlapped or abutted beneath the handle 17.

Figure 2:
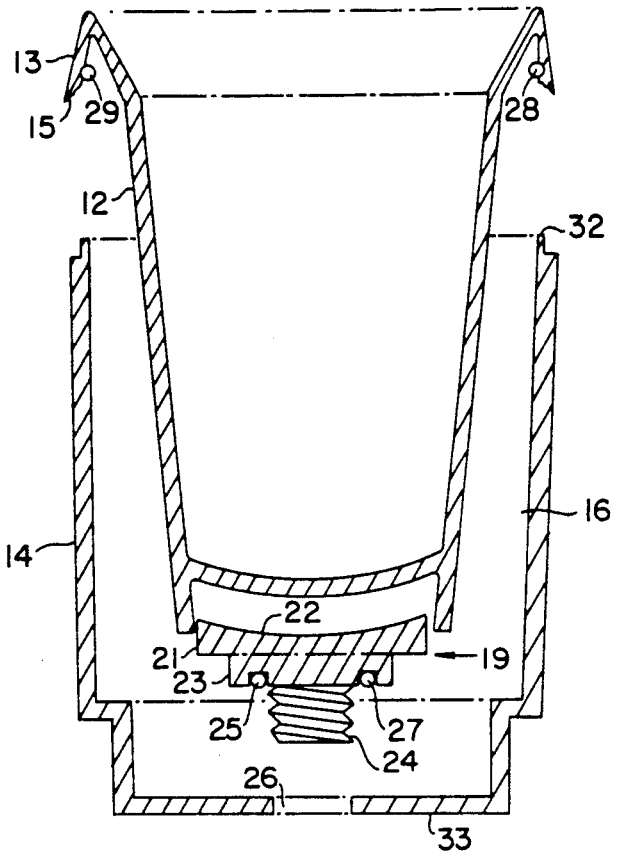
FIG. 2 is an exploded view in section of a preferred embodiment of an insulated drinking mug according to the present invention.

As shown in FIG. 2, a plug 19 is firmly secured to the lower surface of the basket 12. The plug 19 is generally circular and includes an enlarged attachment section 21 having a smooth upper surface 22 and a radially extending flange 23. An externally threaded cylindrical stud 24 projects from the lower surface of the flange 23 and extends normal thereto. An annular groove 25 is formed in the lower surface of the flange 23 surrounding the stud 24. The plug 19 is bonded to the exterior surface of the basket, such as by sonic welding, permanent adhesive, etc., with the central axis of stud 24 lying on an extension of the central axis of the basket. An internally threaded opening 26 is formed in the bottom 33 of the housing. A small O-ring 27 is positioned in the groove 25 and a larger O-ring 28 is positioned in an internally directed annular groove 29 formed adjacent the distel edge 15 of the down-turned rim 13.

The various parts of the mug are formed of thermosetting plastic suitable for injection molding. The receptacle or basket 12 and the handle 17 are of complementary or matching colors and are generally opaque, while the housing 14 is clear and transparent. The placard 18 is formed of suitable thin cardboard, such as double layer bristol board, and may be white or any desired color, but a color which complements the colors of the basket and handle is preferred. The placard is provided with one or more openings 31 which are adapted to frame a photograph or picture. The external surface of the placard is adapted to be inscribed with pre-printed or written phrases or messages suitable to the particular user of the mug.

To assemble the present mug, one or more photographs or snapshots, the subject matter of which is of particular interest to the individual user, such as, family members, friends, pets, memorable events, places, etc., are each affixed to the back of the placard 18 with a spot of glue or plastic tape, so the subject matter of each photograph is framed in an opening 31. The placard may be provided with a standard sequence of openings or may be blank to permit the user to cut the number, size and arrangement of openings desired. When the photographs are in place and any messages are inscribed on the outside of the placard, it is rolled into tubular form and inserted within the housing. The stress within the material of the placard causes the placard to be forced into contact with and conform to the interior surface of the housing. The position of the placard can be adjusted so that the joint between the ends thereof is located below and in line with the handle. The basket 12 is then inserted within the housing until stud 24 is received within opening 26. The basket is then twisted within the housing to engage the threads on the stud with those in the opening. Progressive engagement of the threads draws the basket into the housing until the O-ring 27 and 28 are firmly seated against the internal surface of the bottom 33 of the housing and against the upper edge 32 of the housing, respectively. Compression of the O-rings seals the annular space 16 and prevents fluids from coming into contact with the placard. Access can be obtained to the placard for modification or updating by twisting the basket in the opposite direction to disengage the stud 24 from the opening 26.

Figure 3:
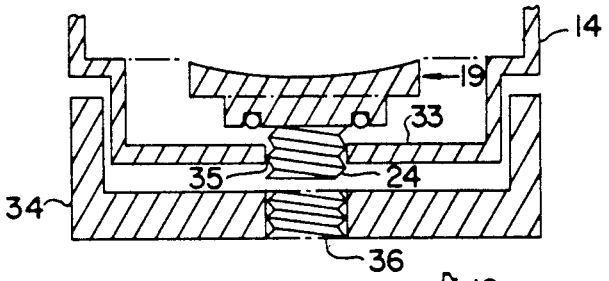
FIG. 3 is a partial view in section of an alternate base construction for the mug of FIG. 2.

A modification of the insulated mug of FIG. 2 is illustrated in FIG. 3 wherein an ornamental base 34 is attached to the bottom of the housing. In this construction, the stud 24 extends through an unthreaded opening 35 in the bottom 33 of the housing 14 and is received within an internally threaded opening 36 in the base 34. Relative rotation of the base and the basket causes the housing to be clamped firmly in place therebetween.

Figure 4:
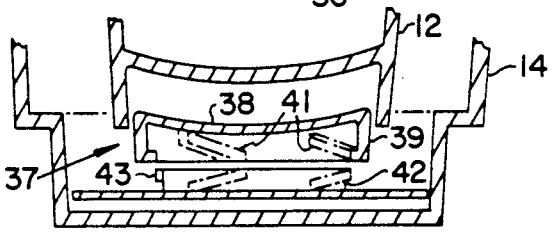
FIG. 4 and FIG. 5 are exploded partial views in section of further base constructions for the mug of FIG. 2.
Figure 5:
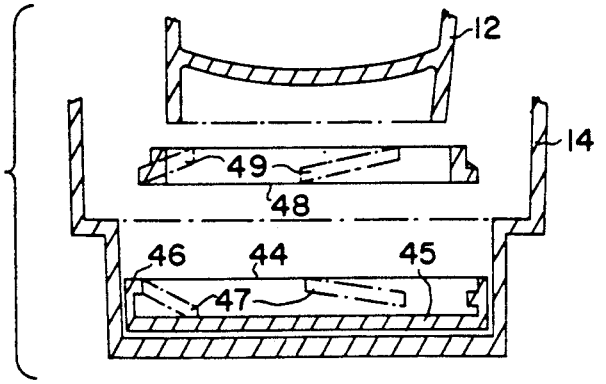

Alternative screw-type connections between the basket and the housing are illustrated in FIGS. 4 and 5. In FIG. 4, the connector includes a shallow cylindrical member 37 which has a smooth attachment surface 38 which conforms to the lower surface of the basket and a depending annular wall 39 which is provided with an internal segmented thread 41. A relatively thick disc 42 has a smooth attachment surface and a peripheral edge which is provided with an external segmented thread 43. The member 37 is secured to the basket 12 with the surface 38 bonded to the lower surface of the bottom of the basket. Disc 42 is secured to the housing 14 with the attachment surface bonded to the upper surface of the bottom of the housing. When the basket is inserted within the housing, disc 42 is received within the recess defined by wall 39. Rotation of the basket causes engagement of the threads 41 and 43 which seats the basket firmly within the housing.

In FIG. 5, the connector includes a shallow dish-like member 44 having a flat base 45 surrounded by an upstanding wall 46 which is provided with an internal segmented thread 47. An annular member 48 is provided with an external segmented thread 49. The flat base 45 is bonded to the interior surface of the bottom of the housing 14 and the annular member 48 is telescoped over the lower edge of the basket and bonded to the exterior surface thereof. When the basket is pushed into the housing the annular member 48 is received within the interior of the member 44 such that rotation of the basket then causes engagement of the threads 47 and 49, drawing the basket into firm engagement with the housing.

Figure 6:
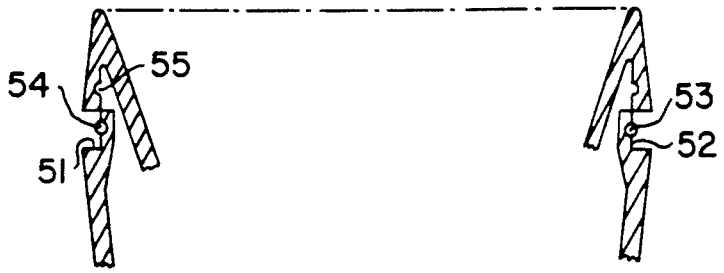
FIG. 6 is a partial view in section of an alternate joint construction for the present mug.

Further modifications are illustrated in FIGS. 6–9. In FIG. 6, the upper edge of the housing is formed with a radially extending ledge 51 and an upstanding lip 52. An annular groove 53 in the lip 52 receives an O-ring 54. The rim is provided with an internal annular groove 55 which receives the O-ring 54 when the rim is telescoped over the lip and brought into contact with the ledge 51. Since the internal circumference of the rim closely approximates the external circumference of the lip, this embodiment provides a snap-type connection between the basket and the housing which is fluid tight.

Figure 7:
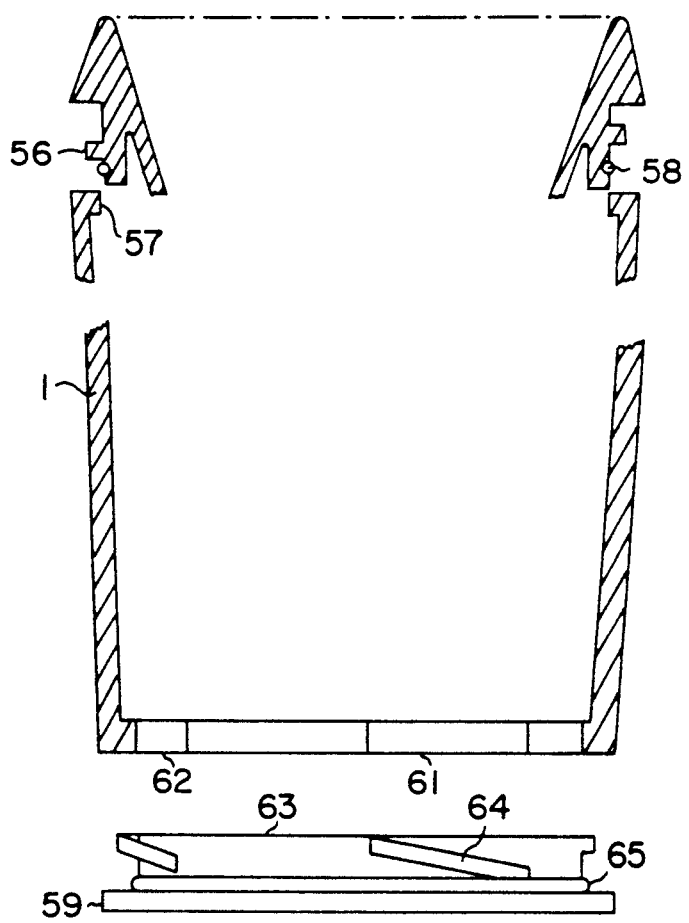
FIG. 7 is an exploded view in section of an alternate embodiment of an insulated drinking mug.

In FIG. 7, the rim is provided with an external segmented thread 56 which engages oppositely-directed internal thread segments 57 on the upper edge of the housing 14. An O-ring 58 is carried by the rim and bears against the internal surface of the housing when the thread segments are engaged. In this embodiment, a separate base 59 is attached to the lower edge of the housing. An enlarged opening 61 in the bottom of the housing is provided with an internal segmented thread 62. The base 59 includes a cylindrical projection 63 which is provided with an external segmented thread 64. An O-ring 65 is carried by the projection below the thread 64. Rotation of the projection 63 within the opening 61 causes progressive engagement of the threads 62 and 64 and compression of the O-ring 65 to seal the joint between the base and the housing.

Figure 8:
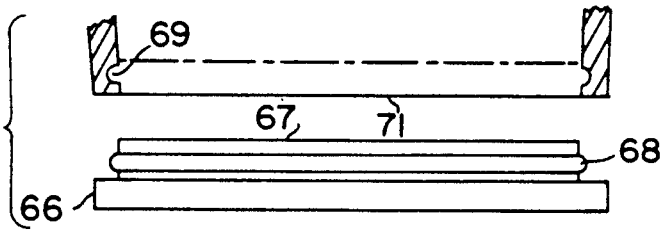
FIG. 8 and FIG. 9 are partial views in section of further base constructions for the present mug.

FIG. 8 illustrates a snap-type connection between the base 66 and the housing. The projection 67 carries an O-ring 68 which is received within an annular groove 69 when the projection is forced into the opening 71 in the bottom of the housing. The opening 71 and projection 67 are dimensioned to provide a close fit, so that O-ring 68 is compressed therebetween and retains the base in position and seals the joint between the housing and the base when the projection is forced into the opening. The groove 69 need not be pronounced and may be omitted entirely if the wall of the housing converges toward the base.

Figure 9:
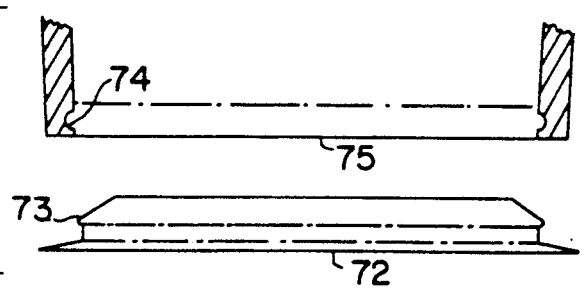

An alternative snap-type construction is illustrated in FIG. 9 wherein the base 72 is formed of a moderately flexible material, such as synthetic rubber, and includes an annular protrusion 73 which serves as an integral O-ring and is received within a groove 74 when the base is snapped into the opening 75 in the bottom of the housing.

While the present invention has been disclosed and described as applied to an insulated drinking mug, it should be understood that the teachings of the invention are equally applicable to other cylindrical fluid-retaining vessels or receptacles, such as vases, tankards, drinking glasses, etc., by varying the dimensions and omitting, or modifying, the handle.

It will be obvious to those skilled in the art that various changes may be made without departing from the scope of the invention and the invention is not to be considered as limited to what is shown in the drawings and described in the specification.

What I claim as my invention is:

1. A mug which includes an interior fluid receptacle adapted to be telescoped within an exterior housing, said receptacle and housing being so dimensioned as to define an annular space therebetween, and a decorative personalized placard with openings to receive photographs of a users choice positioned in said space, said housing having a supporting base and a generally cylindrical transparent wall protruding therefrom, said receptacle being a generally cylindrical member with a closed end and an open end, the open end having a continuous surface formed by the material of the receptacle folded back upon itself to form an annular rim depending from said surface to provide a fluid-tight seal between the receptacle and housing, and means for disassembling the transparent wall from the supporting base, said means including a flat surface on said base adapted to bear against an edge of the transparent wall and a cylindrical protrusion adapted to be received within the interior of the wall, and a compressible O-ring mounted on the protrusion so as to bear against said wall and retain said protrusion against said wall and seal the joint therebetween.

2. A mug as defined in claim 1 wherein the protrusion is provided with external segmented threads and the edge of the wall is provided with internal segmented threads which are progressively engaged by relative rotation of the base and wall to draw the flat surface firmly against the wall and compress the O-ring.

* * * * *